US011805368B2

(12) United States Patent
Herger

(10) Patent No.: US 11,805,368 B2
(45) Date of Patent: Oct. 31, 2023

(54) LOUDSPEAKER

(71) Applicant: Sotis AG, Altdorf (CH)

(72) Inventor: Danilo Herger, Burglen (CH)

(73) Assignee: Sotis AG

( * ) Notice: Subject to any disclaimer, the term of this patent is extended or adjusted under 35 U.S.C. 154(b) by 211 days.

(21) Appl. No.: 17/421,565

(22) PCT Filed: Aug. 12, 2020

(86) PCT No.: PCT/IB2020/057565
§ 371 (c)(1),
(2) Date: Jul. 8, 2021

(87) PCT Pub. No.: WO2021/245453
PCT Pub. Date: Dec. 9, 2021

(65) Prior Publication Data

US 2022/0345825 A1 Oct. 27, 2022

(30) Foreign Application Priority Data

Jun. 2, 2020 (RU) ..... 2020118126

(51) Int. Cl.
*H04R 9/06* (2006.01)
*H04R 9/04* (2006.01)
(Continued)

(52) U.S. Cl.
CPC ..... *H04R 9/046* (2013.01); *H04R 1/06* (2013.01); *H04R 9/025* (2013.01); *H04R 9/04* (2013.01);
(Continued)

(58) Field of Classification Search
CPC . H04R 1/06; H04R 9/025; H04R 9/04; H04R 9/045; H04R 9/046; H04R 9/06; H04R 2209/041; H04R 2499/11
See application file for complete search history.

(56) References Cited

U.S. PATENT DOCUMENTS 4,322,584 A * 3/1982 Shimada ..... H04R 9/046 381/407
6,332,029 B1 12/2001 Azima et al.
(Continued)

FOREIGN PATENT DOCUMENTS

WO 9531805 A1 11/1995
WO 9601547 A2 1/1996

OTHER PUBLICATIONS

Carlsbro Flat Panel speaker model NLightN, with product information available at: www.gear4music.com/US/en/PA-DJ-and-Lighting/DISC-Carlsbro-NlightN-Flat-Speaker-Each/5X9, prior to Jun. 2, 2020.

(Continued)

*Primary Examiner* — Huyen D Le

(57) ABSTRACT

A loudspeaker is proposed, having an enclosure where the following components are installed: a magnetic circuit, a permanent magnet, a coil, a system positioning the coil in the gap between the enclosure and a permanent magnet, a resonating membrane diffuser, attached by an attachment mechanism to the coil, and lead wires with terminals. The coil is star-shaped. The technical result is to increase the loudspeaker's power and efficiency, to reduce its weight and size, and to improve the sound quality.

2 Claims, 4 Drawing Sheets

(51) Int. Cl.
*H04R 9/02* (2006.01)
*H04R 1/06* (2006.01)

(52) U.S. Cl.
CPC ..... *H04R 9/045* (2013.01); *H04R 9/06* (2013.01); *H04R 2209/041* (2013.01); *H04R 2499/11* (2013.01)

(56) References Cited

U.S. PATENT DOCUMENTS

| | | | | |
|---|---|---|---|---|
| 6,618,487 | B1 * | 9/2003 | Azima | H04R 5/02 381/396 |
| 8,798,309 | B2 | 8/2014 | Tagami et al. | |
| 2008/0101648 | A1 * | 5/2008 | Hatanaka | H04R 9/025 381/412 |
| 2011/0261990 | A1 * | 10/2011 | Kosuda | H04R 9/045 381/398 |
| 2013/0266160 | A1 * | 10/2013 | He | H04R 25/554 381/312 |

OTHER PUBLICATIONS

Dayton Audio model DAEX30HESF, with product information available at: www.daytonaudio.com/product/1229/daex30hesf-4-high-efficiency-steered-flux-exciter-with-shielding-30-mm-exciter-40w-4-ohm, prior to Jun. 2, 2020.

* cited by examiner d1=50mm
L1=157mm 12 beams
d2=40mm
D2=50mm
L2=357mm

D3=126mm
L3=357mm

LOUDSPEAKER

CROSS REFERENCE TO RELATED APPLICATION

This application is a National Stage Application of PCT/IB2020/057565 filed Aug. 12, 2020, which claims priority from Russian Patent Application No. 2020118126 filed on Jun. 2, 2020. The priority of said PCT and Russian Patent Application are claimed. Each of the prior mentioned applications is hereby incorporated by reference herein in its entirety.

FIELD OF THE INVENTION

The invention relates to acoustics, particularly to acoustic systems' flat loudspeakers.

BACKGROUND OF THE INVENTION

There is a known loudspeaker, described in the patent of the Russian Federation No. 2595649C2 dated Aug. 27, 2016. This loudspeaker includes: a ring-shaped magnet; a yoke containing a central pole section inserted into the magnet's center; an annular plate located outside the peripheral surface of the said yoke's central pole section and attached to the magnet; a cylindrical coil former, mounted with the possibility of axial movement of said central pole section, the coil former being partially adjacent to said yoke's central pole section; a voice coil wound around the coil former, with at least a part of the voice coil located in a magnetic gap between said plate and said yoke's central pole section; a diaphragm with its inner circumference connected to the coil former, with the diaphragm oscillating as the coil former moves; and a magnetic flowing medium filling the magnetic gap. This loudspeaker is, in fact, not flat and belongs to the general state of the art.

There are technical solutions known from the prior art similar to the proposed solution. For example, the international patent WO9601547 dated Jan. 18, 1996 proposes the use of flat panel loudspeakers with a piezodynamic drive for direct installation in the wall of a laptop lid. The disadvantage of this loudspeaker is that it cannot effectively operate in the frequency range below 200 Hz, and its immediate operating range features high degree of unevenness, with dips and bursts at the loudness level of 30 Db, despite the fact that in hi-end equipment, the norms of frequency response non-uniformity are (+−) 3 Db in the entire operating frequency range.

The other international patent—WO9531805 dated Nov. 23, 1995 proposes using flat acoustic systems installed in a tablet computer with an active noise cancellation system including vibration exciters based on a piezoelectric drive All of the above mentioned inventions have a number of disadvantages such as: a narrow frequency range of the loudspeaker, usually not exceeding 200 Hz. Insufficient quality indicators regarding the loudspeaker's amplitude-frequency response, as well as the low level of the speakers' developed power.

The closest counterpart to our invention is the device described in the U.S. Pat. No. 6,332,029 by Henry Azim dated Dec. 18, 2001. It describes an acoustic device with a flat membrane, containing at least one acoustic vibration drive, installed in space opposite a special place attached to the membrane, operating on the flexural resonance modes principle. This patent indicates the possibility of using one or several acoustic vibration wires within one membrane. If multiple drives are used to create the required power level, harmful modulations occur at a certain frequency; to eliminate them one has to resort to various complex technical solutions, such as cuts of the complex shape membrane's ends, membrane's stiffness varying over its area, various damping options, installation of balance masses, etc. All these measures, in one way or another, lead to energy losses of such a loudspeaker and a decrease in its overall efficiency. Because of several drives operating in-phase, parasitic resonances and modulations arise that reduce the sound quality characteristics. Also, this patent describes the maximum possible (recommended) coil diameter associated with the coincidence frequency of this type of membrane within one drive; in general, this means that reducing the coil diameter is extremely effective.

It is also known that the coil's diameter, the number of turns, and the coil applied voltage level determine its power indicators. Thus, all other things being equal, the coil's power directly depends on its diameter, since the length of its circumference completely depends on its diameter, that is, the length of one turn of copper wire.

SUMMARY OF THE INVENTION

In case of using a star-shaped coil in the electrodynamic drive of a loudspeaker, it becomes possible to increase the length of one turn in the coil. Thus, a kind of rolled-up system allows, within a small radius and dimensions of an electromagnetic drive, to obtain a sufficiently powerful electromagnetic system, thereby reducing parasitic resonances due to the possibility of using one drive, instead of several low-power ones.

The technical result is to increase the loudspeaker's power and efficiency, to reduce its weight and size, and to improve the sound quality.

The technical result is achieved by the loudspeaker having an enclosure where the following components are installed: a magnetic circuit, a permanent magnet, a coil, a system positioning the coil in the gap between the enclosure and a permanent magnet, a resonating membrane diffuser, attached by an attachment mechanism to the coil, and lead wires with terminals. The coil is star-shaped.

It is also obvious that the shape of the star-shaped coil's beams ends can be either an angle, an arc, a rectangle, or a combination of the above.

BRIEF DESCRIPTION OF THE DRAWING

The invention is illustrated by figures.

Figure 1:
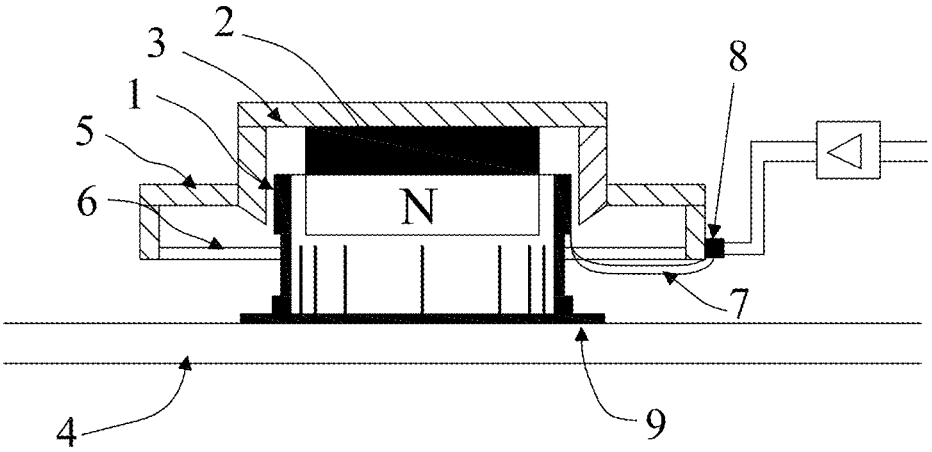
FIG. 1 depicts an overview of the proposed loudspeaker.

A glossary of reference characters used in the figures is-provided below:

| Reference Character | Feature or Element |
|---|---|
| 1 | Star-shaped coil |
| 2 | Permanent magnet |

-continued

| Reference Character | Feature or Element |
|---|---|
| 3 | Magnetic circuit |
| 4 | Resonant membrane (diffuser) |
| 5 | Enclosure |
| 6 | System for positioning the coil in the gap |
| 7 | Lead wires |
| 8 | Terminals |
| 9 | Attachment mechanism for attaching the coil to the membrane |
| 10 | Beams |
| 15 | Cavities |
| 20 | Beam end |

DETAILED DESCRIPTION

The proposed technical solution is an electrodynamic drive for converting the electrical signal of the acoustic range from the amplifier into mechanical energy of the of the cone speakers and flat-type acoustics' sound-emitting system, operating on the principle of a resonating membrane.

The invention includes the star-shaped coil 1 (see 1/4). This is a complex, special configuration, tubular-frame structure with a conductive wire of a certain section wound on it and fixed in it, looking as a a star in cross-section. When an electric current is connected to such a coil, a magnetic field is induced in the general approximation of a toroidal configuration. It also includes a magnetic system consisting of a permanent magnet 2 and preferably a ferrite core 3. A closed or open configuration that forms a thin magnetic field strength gap corresponding to a star-shaped coil, with a thickness that implies an unobstructed reciprocating motion of the coil within this gap. It also includes a system for positioning the coil in the gap 6, usually consisting of two centering washers made of some kind of fabric, and having a corrugated annular shape, or representing a thin metal rod entering one end into a corresponding sleeve attached to the central axis of the magnetic system, and the other one attached directly to the star coil. The proposed device also includes an enclosure 5, flexible wires for supplying a signal to the moving coil 7, connection terminals 8 and a device 9 for attaching the coil to the body of the resonating membrane (diffuser) 4.

Figure 2A:
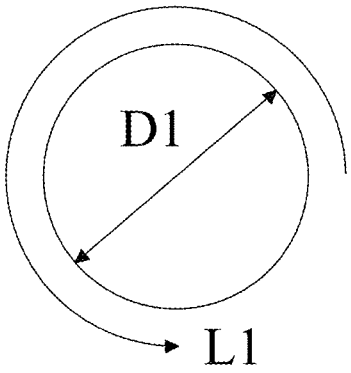
FIG. 2A-2B depict the difference in the length of one turn of a wire of a cylindrical coil and a star-shaped coil having identical diameters D1=D2.
Figure 2B:
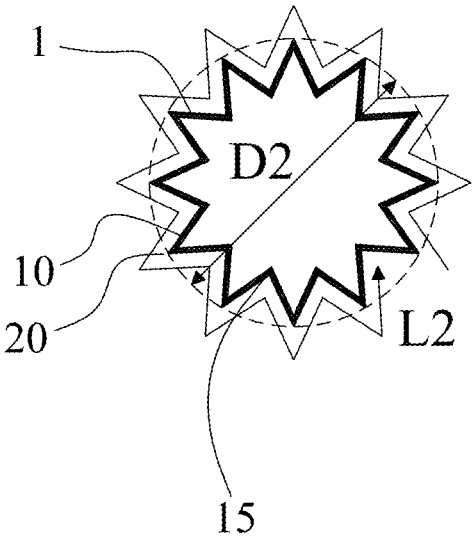

As shown in FIG. 2A, a common loudspeaker configuration used in the closest counterparts consists of a circular section moving coil with a diameter D1 and a circumference L1. The number of coil wire's turns multiplied by the length of one turn L1 determines the overall mechanical efficiency. The circumference parameter L1 corresponds to the length of the working magnetic gap with a certain magnetic flux. As shown in FIG. 2B, the coil 1 is formed with a plurality turns, wherein each turn of the coil is formed with, or bent into, a star-shaped configuration with twelve alternating uniformly-distributed beams 10, i.e., protrusions or rays, and cavities 15, i.e, recesses. Each of the beams 10 having respective beams ends 20. In FIG. 2B, the star-shaped coil 1 has an outer diameter D2 that is equal to the outer diameter D1 depicted in FIG. 1, and the length of one turn of the coil L2 that is n times larger than L1 depicted in FIG. 1, as further illustrated in FIGS. 3A-3C. So the power will be determined by the number of turns in relation to the parameter L2 of one turn's length, corresponding to the length of the magnetic gap.

Figure 4A:
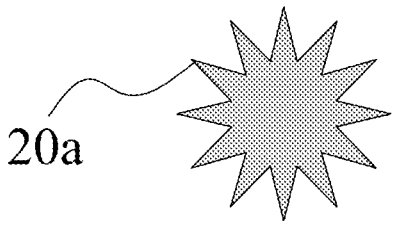
FIG. 4A-4E depict different shapes of beams ends useable with the star-shaped coils in accordance with the invention.
Figure 4B:
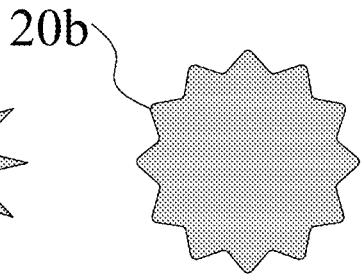
Figure 4C:
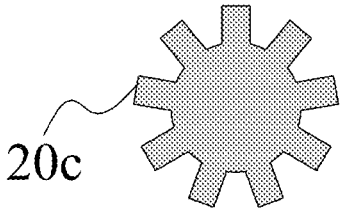
Figure 4D:
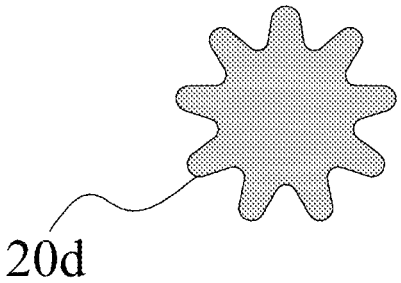
Figure 4E:
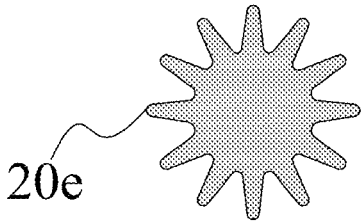

As shown in FIGS. 4A-4E, the shape of the star-shaped coil's beams ends 20 can be different. For example, FIG. 4A depicts beams ends 20*a* having a shape of an angle (and it can be either acute or obtuse), FIG. 4C depicts beams ends 20*c* having a shape of a rectangle and FIGS. 4B, 4D 4E depict respective beams ends 20*b*, 20*d*, and 20*e* having a shape of an arc or curve with different radii. Further, one or more of the shapes of the beams ends 20*a*-20*e* in FIGS. 4A-4E may be combined.

Figure 3A:
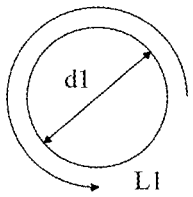
FIG. 3A-3C depict the benefits of a star-shaped coil winding relative to a cylindrical winding, each with a diameter of 50 mm.
Figure 3B:
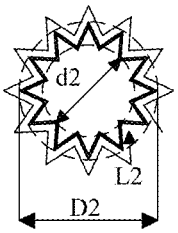
Figure 3C:
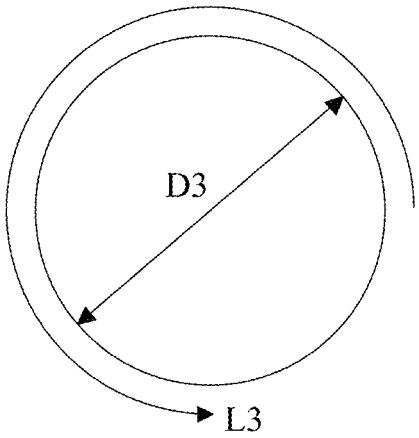

In FIGS. 3A-3C, one can see the advantage of a star-shaped coil in a specific example. When using a cylindrical coil with a diameter of 50 mm as depicted in FIG. 3A, the length of one turn of wire will be 157 mm. If such cylindrical coil is replaced with a star-shaped coil of the same outer diameter, consisting of 12 beams as depicted in FIG. 3B, the length of one turn of the wire will be 357 mm, which is more than 2 times longer. With the same nominal resistance of both coils, the power of the star-shaped one will be higher, and the heat dissipation is less. If one makes a cylindrical coil of the same power, it would have a diameter of 126 mm as depicted in FIG. 3C. Mounting such a coil in a compact loudspeaker system will be very difficult, and the acoustic properties will be characterized by greater unevenness in properties, such as a spike in the amplitude of parasitic oscillations within the limits of the coil mounting ring, which will not allow using such a loudspeaker system in conditions demanding high sound quality.

A flat-type loudspeaker by Carlsbro (https://musicland.ru/catalogue/model/Carlsbro-NlightN-Flat-Panel/), (https://www.fast-and-wide.com/equipment-releases/loudspeakers-sound-reinforcement/1234-carlsbro-nlightn) uses an assembly of 6 electrodynamic exciters, determining the total power of the panel at a level of 100 W, such a solution has a significant drawback—the intermodulation of surface traveling waves arising from numerous sources of acoustic excitation; this way, the primary sound picture is distorted at the level of sound radiation into the environment, the amplitude-frequency response of the acoustic system is distorted, a parasitic tone appears in the sound. In ideal conditions, such a power should be possessed by one single actuator attached to a strictly defined place of the geometric position on the membrane. In this case, the coil's diameter should be kept to the minimum possible to reduce modulation distortion within the coil mounting ring.

When using the proposed technical solution, a "star-shaped coil" will provide a number of significant advantages:

- the amplitude-frequency characteristic will have an even component within the entire operating range;
- the operating range has been significantly expanded in the lower register from 100 Hz on the Carlsbro panel, to 28 Hz on the panel with a star-shaped drive.

Using the proposed technical solution, namely the "star-shaped coil", in various known loudspeakers (speakers) will increase the power of such an acoustic system. Thus, two or more speakers are installed in one enclosure to create the required acoustic pressure limit. In the case of using an electrodynamic drive with a star-shaped coil, it becomes possible to create a more powerful and compact speaker that can replace two or more conventional speakers.

The experiment with a flat loudspeaker resulted in the following achievements. Standard electrodynamic exciters by Dayton (https://www.parts-express.com/dayton-audio-daex30hesf-4-high-efficiency-steered-flux-exciter-with-shielding-30 mm-40 w-4-oh-295-240) used 4 exciters with a power of 40 W to create a flat loudspeaker with a power of 160 W. As a result, the assembly of 4 exciters was stretched within the panel length by more than 220 mm. At 800 Hz, an intermodulation rise in amplitude was recorded, which distorted the frequency response of the panel in this range, resulting in a 6 dB overshoot. When using of one actuator with a star-shaped coil with an outer diameter of 32 mm, which fully corresponds to the coil diameter of a standard electrodynamic exciter by Dayton, a result of 160 W was obtained on one device, which allowed reducing the number of electric exciters from four to one with constant power. As a result of this improvement, the final frequency response of the panel has returned to normal and is within the range of plus or minus 3 decibels from 40 hertz to 18 kilohertz, and the operating frequency range has expanded in the low range, often from 50 to 40 hertz.

The invention claimed is:

1. A loudspeaker comprising:

an enclosure having installed therein:

a magnetic circuit, a permanent magnet with a gap between the enclosure and the permanent magnet, a coil having a plurality of turns, wherein each turn of the coil is formed into a star shape configuration having a plurality of alternating beams and cavities, and a system configured for positioning the coil in the gap between the enclosure and the permanent magnet;

a membrane attached by an attachment mechanism to the coil; and lead wires attached to terminals and to the coil.

2. A loudspeaker according to claim 1, wherein each beam of the plurality of beams of the turns of the coil has a respective beam end, and each beam end has a respective shape of at least one of an angle, arc, or rectangle; or a combination thereof.

* * * * *